US007213349B1

(12) United States Patent
Brunner

(10) Patent No.: US 7,213,349 B1
(45) Date of Patent: May 8, 2007

(54) HEAT RECOVERY SYSTEM FOR CLOTHES DRYER

(76) Inventor: Richard A. Brunner, 407 S. Bonsall Rd., Coatesville, PA (US) 19320-1631

( * ) Notice: Subject to any disclaimer, the term of this patent is extended or adjusted under 35 U.S.C. 154(b) by 0 days.

(21) Appl. No.: 11/496,782

(22) Filed: Aug. 1, 2006

(51) Int. Cl.
*F26B 11/02* (2006.01)

(52) U.S. Cl. ..... 34/86; 68/20

(58) Field of Classification Search ..... 34/380, 34/381, 86, 89, 90, 595, 597, 606; 134/10, 134/11; 68/18 F, 20
See application file for complete search history.

(56) References Cited

U.S. PATENT DOCUMENTS

| | | | | |
|---|---|---|---|---|
| 3,969,070 | A | 7/1976 | Thompson | |
| 3,999,304 | A | 12/1976 | Doty | |
| 4,034,482 | A | 7/1977 | Briscoe | |
| 4,137,647 | A | 2/1979 | Clark | |
| 4,227,315 | A | 10/1980 | Hight | |
| 4,348,818 | A | 9/1982 | Brown | |
| 4,434,564 | A | 3/1984 | Braggins, Jr. | |
| 4,689,896 | A * | 9/1987 | Narang | 34/82 |
| D297,044 | S | 8/1988 | Van Ee | |
| 4,875,298 | A * | 10/1989 | Wright | 34/86 |
| 4,930,571 | A * | 6/1990 | Paull | 165/111 |
| 5,117,563 | A | 6/1992 | Castonguay | |
| 5,272,781 | A * | 12/1993 | Bastin et al. | 8/158 |
| 5,497,563 | A * | 3/1996 | Mayfield | 34/572 |
| 6,220,095 | B1 * | 4/2001 | Fennel et al. | 73/514.08 |
| 6,671,977 | B2 * | 1/2004 | Beaumont | 34/79 |
| 6,785,981 | B1 * | 9/2004 | Harpenau | 34/140 |
| 6,941,680 | B1 | 9/2005 | Zielewicz | |
| 7,055,262 | B2 * | 6/2006 | Goldberg et al. | 34/86 |
| 2003/0208923 | A1 * | 11/2003 | Lewis | 34/471 |
| 2006/0179676 | A1 * | 8/2006 | Goldberg et al. | 34/77 |

* cited by examiner

*Primary Examiner*—S. Gravini
(74) *Attorney, Agent, or Firm*—Vincent Tassinari

(57) ABSTRACT

While venting clothes dryer heat outside may be acceptable during the summer months, it is desirable to reuse such heat once the outside temperature starts to fall. The disclosed heat recovery unit for a clothes dryer works towards meeting this need. The heat recovery unit may include a housing having a support box and a cover attached to the support box by a hinge. The cover may include an exhaust register and an indicator light cover through which a 'clean filter now' light, a 'low flow' light, and a 'high temperature warning' light may be viewed when lit. The heat recovery unit also may include a controls box positioned in the support box, where the controls box maintains electronic intelligence of the recovery unit. A recovery unit fan may be positioned in the support box to blow room temperature air up through a heat exchanger in the support box. An internal bypass channel may channel clothes dryer air around and outside of the heat exchanger during hot days. A filter in the support box on an inlet side of the heat exchanger may filter out lint and dust and a catch pan located in the support box may catch condensate from a drip pan located in the support box on an exhaust side of the heat exchanger to catch condensate.

18 Claims, 5 Drawing Sheets

HEAT RECOVERY SYSTEM FOR CLOTHES DRYER

BACKGROUND

1. Field of Endeavor

The information disclosed in this patent relates to heat recovery systems and more particularly to recycling heat by recovering clean heat from a clothes dryer, where that heat subsequently may be utilized in heating a home.

2. Background Information

Just about every house in the United States includes a clothes dryer and millions more of them are manufactured each year. Clothes dryers are very reliable, and very cheap to build.

In general, clothes dryers utilize hot air to dry clothes. The basic components of a clothes dryer include a rotating tumbler and a heater. The rotating tumbler holds the clothes and an electric or gas powered heater heats the air that is drawn through the wet clothes as they tumble. The hot air passing through the clothes heats up the clothes and the water in them. Typical clothes dryer additionally include an exhaust vent that passes out of the dryer and out of the house to permit the water to exit the dryer in the form of steam.

With temperatures dropping and electricity and home oil heating prices rising, many consumers are asking, "Why can't I vent my clothes dryer into my house so the heat that currently goes outside stays inside instead?" Presently, this is not a good idea for a variety of reasons.

Hot air coming out of an electric clothes dryer is full of lint, moisture, and dust. Breathing all that lint and dust just is not healthy. In addition, the excess moisture will condense on cold surfaces such as expensive wood tables and electronic equipment not in use. This free roaming moisture from the clothes dryer will cause problems other than damaging household items, including causing mold and aiding termites to damage wood. For gas clothes dryers, small amounts of gas vapor and carbon monoxide may be present in heat exhaust. Breathing in gas vapor and carbon monoxide could cause serious health problems.

For the above reasons, typical clothes dryers are connected to an exhaust duct that is open to the outdoors through a duct hole in a wall of the home. Porting outside the home heat generated by the clothes dryer is waste of valuable heat. An electric dryer consumes 220 volts of electricity to generate great volumes of heat for the drying process. By way of comparison, electric baseboard heaters also utilize 220 volts of electricity to generate heat for the home. As a result, every time that an electric clothes dryer is run, the consumer is venting to the outside an equivalent amount of heat as that generated by an electric baseboard heater over the same period of time.

As another example, a 4–5 person household may average eight clothes dryer cycles per week and thus eight hours dryer utilize per week. Over a typical six months of winter-like cold, this works out to 192 hours of dryer use. Even a two person household may utilize about 96 hours of clothes dryer time over the same period. These figures represent a huge amount of energy use.

In a typical home, the household heating system uses the most energy. However, other home services contribute to heating the home and help reduce the household heating system costs. For example, the water heater is second in energy use, whether the water heater is electric or gas. The water heater adds to heating the home as the water heater's heat largely is conducted into the home. Moreover, a water heater and the pipes servicing the water heater may be made more energy efficient through insulating blankets. The kitchen is third in energy use, but the kitchen too contributes to the heating of the home, with almost 30,000 British Thermal Units (BTUs)/hour. When utilized, kitchen appliances may provide a substantial gain to the home temperature.

The clothes dryer is a lone exception to the list of major home services contribute to heating the home. Except for some incidental radiant heat from the clothes dryer, the heat generated by the close dryer is almost completely lost outside of the home. Recouping the heat generated and presently lost by typical household clothes dryer configurations may provide substantial savings.

In view of the above, what is needed is an apparatus and method to overcome these and other problems.

SUMMARY

While venting clothes dryer heat outside may be acceptable during the summer months, it is desirable to reuse such heat once the outside temperature starts to fall. The disclosed heat recovery unit for a clothes dryer works towards meeting this need. The heat recovery unit may include a housing having a support box and a cover attached to the support box by a hinge. The cover may include an exhaust register and an indicator light cover through which a 'clean filter now' light, a 'low flow' light, and a 'high temperature warning' light may be viewed when lit. The heat recovery unit also may include a controls box positioned in the support box, where the controls box maintains electronic intelligence of the recovery unit. A recovery unit fan positioned in the support box to blow room temperature air up through a heat exchanger in the support box. An internal bypass channel may channel clothes dryer air around and outside of the heat exchanger during hot days. A filter in the support box on an inlet side of the heat exchanger may filter out lint and dust and a catch pan located in the support box may catch condensate from a drip pan located in the support box on an exhaust side of the heat exchanger to catch condensate.

DETAILED DESCRIPTION

Figure 1:
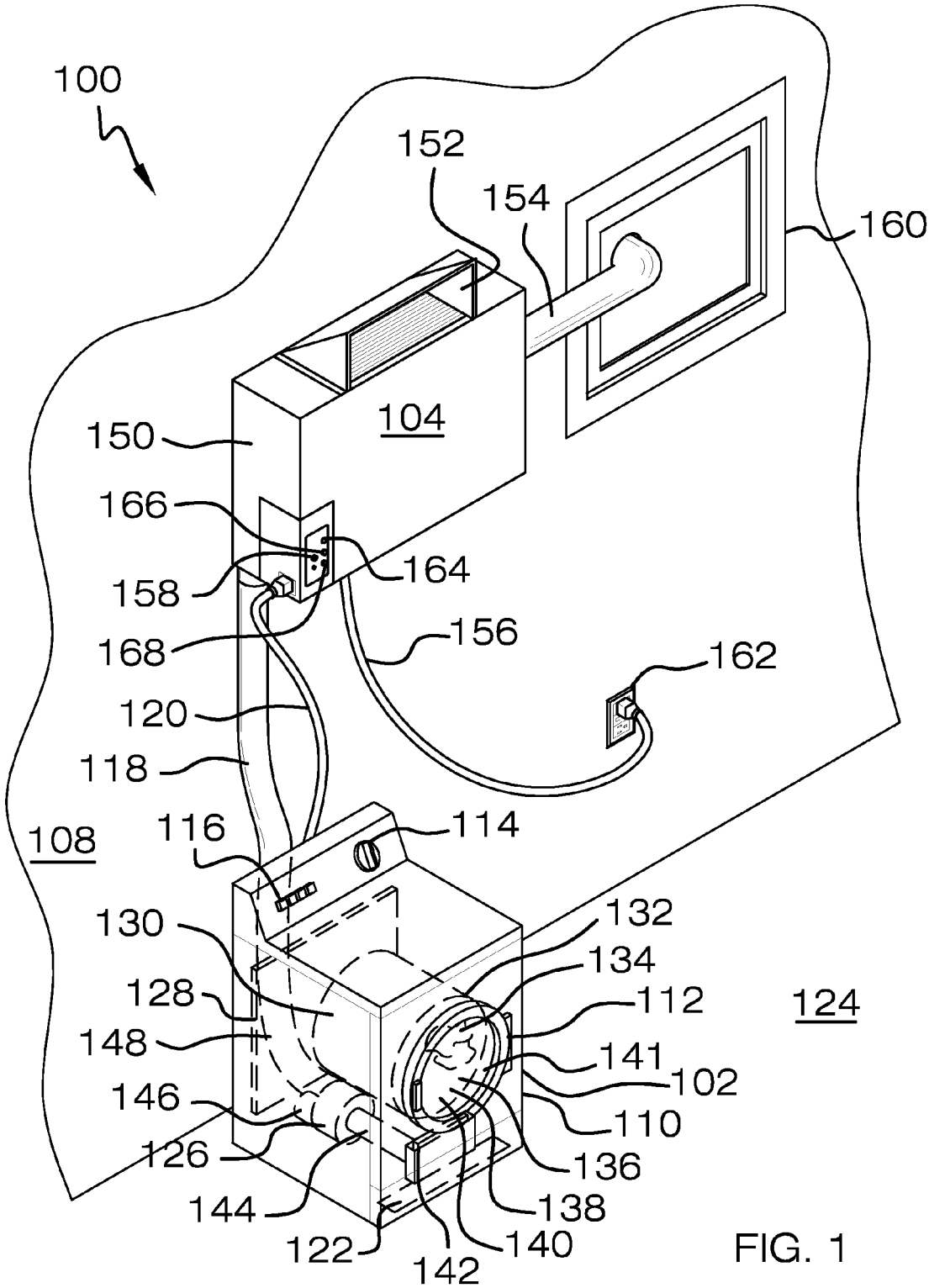
FIG. 1 is an isometric view of a heat recovery system for a clothes dryer (heat recovery system 100)

FIG. 1 is an isometric view of a heat recovery system for a clothes dryer (heat recovery system 100). Heat recovery system 100 may include a clothes dryer 102 and a recovery unit 104. Recovery unit 104 may recycle heat by recovering heat passed from clothes dryer 102. The recycled heat subsequently may be utilized in heating a home 108.

In describing heat recovery system 100, it may help to first have a basic understanding of how a typical clothes dryer operates. With a basic understanding of how a typical clothes dryer operates, it may be clearer to see how the recovery unit 104 interacts with clothes dryer 102.

Clothes dryer 102 may utilize hot air to dry clothes. The basic components of clothes dryer 102 may include a frame 110 supporting a door 112, a cycle control knob 114, heat setting buttons 116, a dryer vent hose 118, and a dryer power cord 120. Frame 110 may have material removed to form a large hole 122 in a front portion of clothes dryer 102. Hole 122 may permit room temperature air 124 to pass into an interior of clothes dryer 102.

In operation, room temperature air 124 is sucked into clothes dryer 102 through large hole 122 by a dryer fan 126. Dryer fan 126 drives all of the air through clothes dryer 102 but is one of the last components to be reached by the air. After arriving inside clothes dryer 102, room temperature air 124 then is sucked past a heating element 128 to form hot air 130. The heating element 128 may be electrical or gas.

Hot air 130 is passed into a tumbler 132. Tumbler 132 is where clothes 134 are loaded for the drying process. As hot air 130 makes its way through clothes 134 in tumbler 132, hot air 130 will picked up moisture, lint, dirt, and any gases released from clothes 134. For a gas dryer, hot air 130 additionally may include gas vapor and carbon monoxide. This new mixture of air—dirty hot air 136 composed of heat 138 and dirty air 140—is then drawn into holes 141 in door 112.

Dirty hot air 136 enters door 112 and is directed down through a lint screen 142. As dirty hot air 136 passes through lint screen 142, lint screen 142 filters out larger lint particles. It then passes through a fan inlet duct 144 in the front of clothes dryer 102 and into dryer fan 126 that is being moved by dryer motor 146. Dryer fan 126 centrifugally forces dirty hot air 136 into a fan exit duct 148 duct leading out the back of clothes dryer 102 to dryer vent hose 118. At this point, both heat 138 and dirty air 140 typically exit home 108 as dirty hot air 136.

It is rather surprising at how much energy heating element 128 of FIG. 1 consumes. Electric heating elements consume 4,000 to 6,000 watts on most dryers. Gas heating elements consume a similar amount of energy. By way of comparison, a 100-watt light bulb uses 100 watts, a typical desktop computer uses 65 watts, and a central air conditioner uses about 3500 watts. What even more surprising is that hot air 130 only makes one pass through clothes 134, whether or not the utilize of hot air 130 to dry clothes 134 has been maximized. Typically porting heat 138 outside of home 108 is a huge waste of energy and the consumer's money.

As noted above, recovery unit 104 may recycle heat by recovering heat 138 passed from clothes dryer 102. As illustrated in FIG. 1, recovery unit 104 may include a housing 150 and an exhaust register 152. Housing 150 may encase many of the contents of recovery unit 104 and exhaust register 152 may vent heated room air 308 (FIG. 3) into home 108 as discussed in more detail below.

Recovery unit 104 additionally may include a recovery vent hose 154, a power cord 156, and indicator light cover 158. Recovery vent hose 154 may port dirty air 140 out home window 160 and power cord 156 may be inserted into home power outlet 162 to provide power to recovery unit 104. Further, visible through indicator light cover 158 when lit may be a 'clean filter now' light 164, a 'low flow' light 166, and a 'high temperature warning' light 168.

Figure 2:
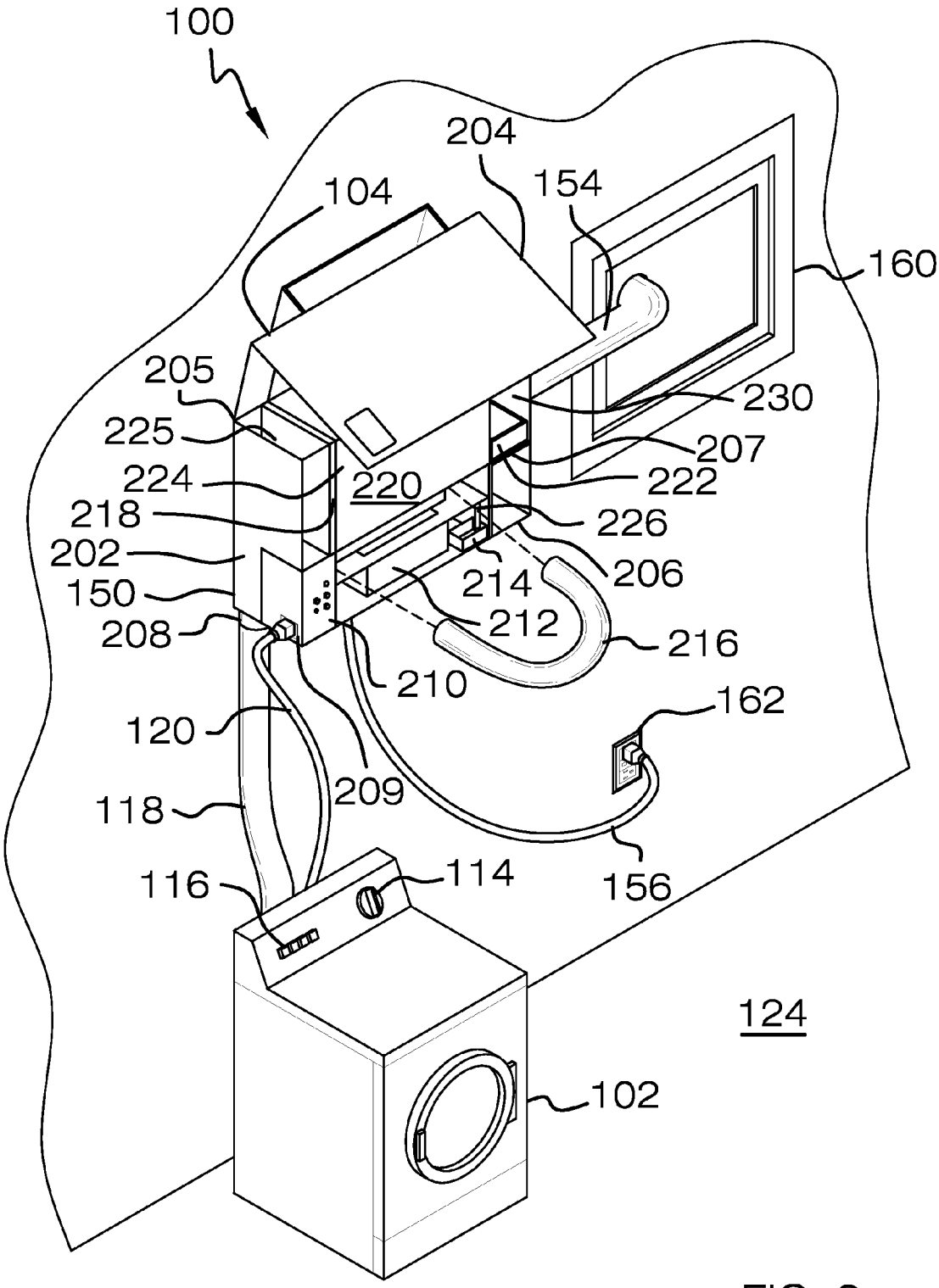
FIG. 2 is an isometric, partially exploded view of heat recovery system 100 in a position different than that illustrated in FIG. 1.

FIG. 2 is an isometric, partially exploded view of heat recovery system 100 in a position different than that illustrated in FIG. 1. Housing 150 may divided into a support box 202 and a cover 204 attached to support box 202 by a hinge 205. Support box 202 may include a first shelf 206 and a second shelf 207.

First shelf 206 of support box 202 may support a first male joint 208, a controls box 210, a recovery unit fan 212, a drip pan 214, and a bypass channel 216. First male joint 208 may be utilized to port dirty hot air 136 into recovery unit 104. Conveniently, clothes dryer 102 need only be connected to recovery unit 104 at two locations. Dryer vent hose 108 may be attached to first male joint 208 and power cord 120 from clothes dryer 102 may be connected to a power outlet 209 of controls box 210. Thus, a consumer utilizing recovery unit 104 need not make more connections for clothes dryer 102 than already required for clothes dryer 102.

Controls box 210 may contain the electronic intelligence of recovery unit 104 as well as various electronic connections. Room temperature air 124 to be heated may be drawn into recovery unit 104 by recovery unit fan 212. Drip pan 214 may serve as a basin for condensation from dirty hot air 136. Bypass channel 216 may ordinarily resides internal to support box 202. However, bypass channel 216 is illustrated in FIG. 2 apart from support box 202 to reveal more features in FIG. 2. During the summer months when there is no need to heat home 108, bypass channel 216 may permit a user to bypass the operations of recovery unit 104 and port hot dirty air 136 directly outside through recovery vent hose 154.

Second shelf 207 of support box 202 may support a filter 218, a heat exchanger core 220, and a catch pan 222. Filter 218 may be utilized to filter out additional lint and dust from hot dirty air 136 that may have been missed by lint screen 142 (FIG. 1). Heat exchanger core 220 may be part of a heat exchanger 224. Importantly, both filter 218 and heat exchanger core 220 may be removably secured in support box 202 to permit easy cleaning of these components. Catch pan 222 may catch condensate drip from heat exchanger core 220 and port the condensate to drip pan 214 through drain tube 226. Alternatively, drain tube 226 may be connected to a drain portion (not illustrated) of a clothes washer.

Along with support box 202, cover 204, and second shelf 207, filter 218 may be positioned in housing 150 to form a dryer air inlet compartment 225 as an entrance staging location for hot dirty air 136. Filter 218 may remove additional lint and dust from hot dirty air 136 and heat exchanger core 220 may provide a method to remove heat 138 from hot dirty air 136 to create cool dryer air 228. Moreover, along with support box 202, cover 204, and second shelf 207, heat exchanger core 220 may be positioned in housing 150 to form a dryer air outlet compartment 230 as an exit staging location for cool dryer air 228.

Figure 3:
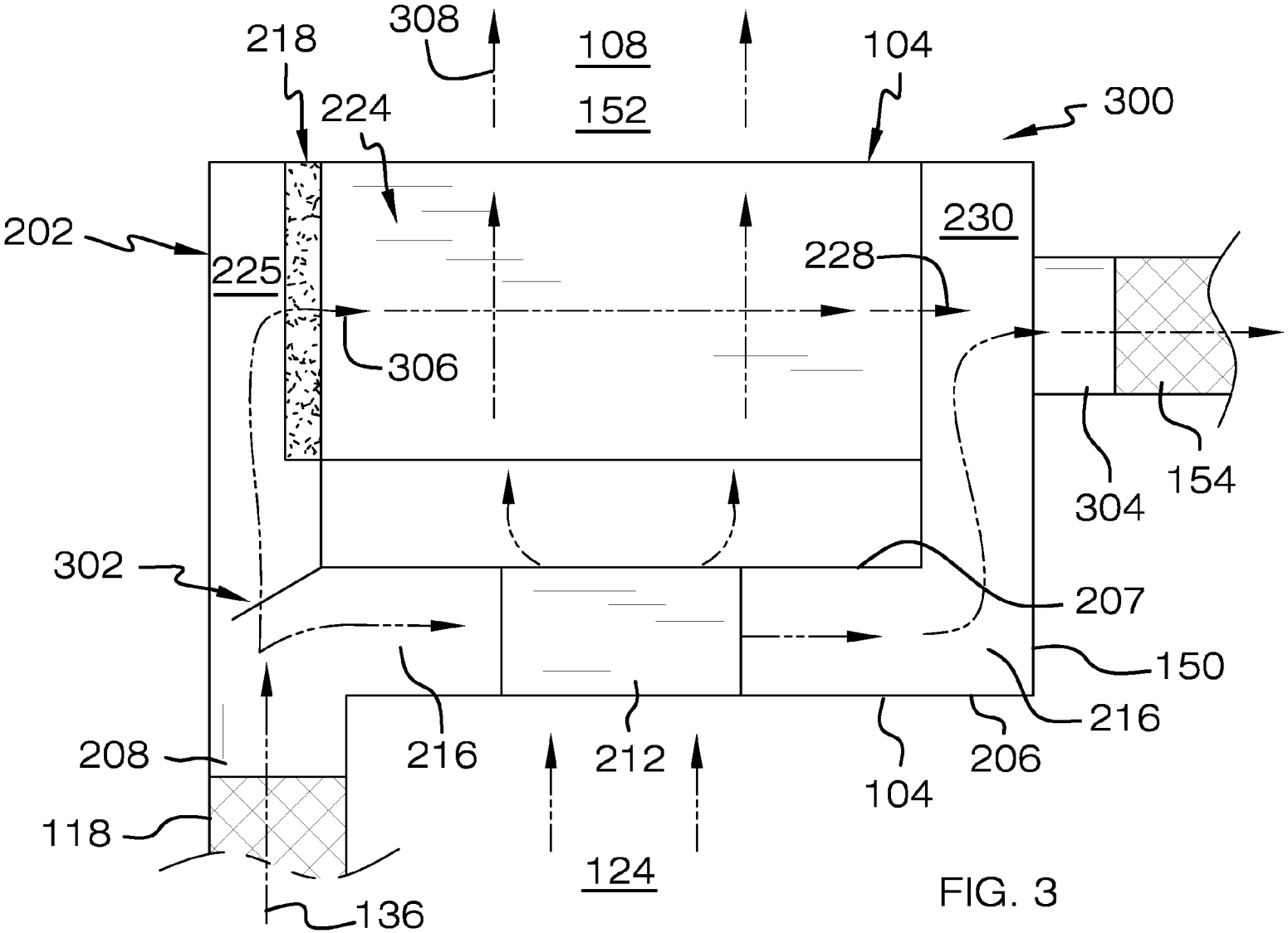
FIG. 3 illustrates a schematic 200 illustrating various air flow paths for recovery unit 104.

FIG. 3 illustrates a schematic 300 illustrating various air flow paths for recovery unit 104. Hot dirty air 136 from clothes dryer 102 may enter recovery unit 104 through male joint 208. During hot days where interior heating of home 150 is not desired, a gate flap 302 (FIG. 3) of recovery unit 104 may be positioned so that hot dirty air 136 travels through bypass channel 216 rather than through heat exchanger 224. Bypass channel 216 may channel hot dirty air 136 through a second male joint 304 (FIG. 3) of recovery unit 104 to recovery vent hose 154.

During cold days where interior heating of home 150 may be desired, gate flap 302 may be positioned so that hot dirty air 136 travels into dryer air inlet compartment 225. From dryer air inlet compartment 225, hot dirty air 136 may pass through filter 218 and into heat exchanger 224 as hot dryer air 306. At the same time, recovery unit fan 212 may draw room temperature air 124 into heat exchanger 224. A cross flow movement of hot dryer air 306 relative to room temperature air 124 may draw heat 138 from hot dryer air 306 into room temperature air 124, crating cool dryer air 228 out of hot dryer air 306 and creating hot temperature air 308 out of room temperature air 124. Hot temperature air 308 may then be ported through exhaust register 152 to heat home 108. Further, cool dryer air 228 may be passed to dryer air outlet compartment 230 and out of home 108.

Figure 4:
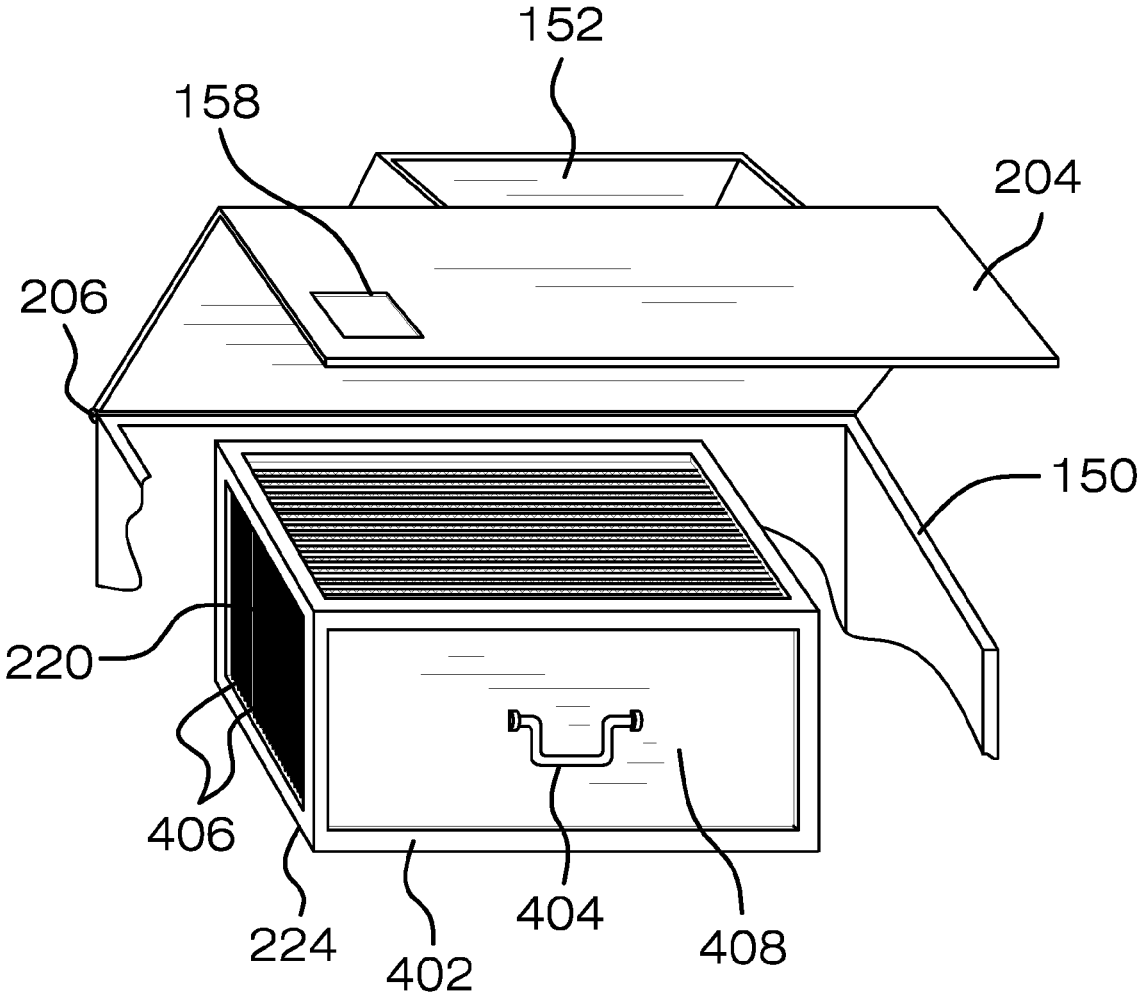
FIG. 4 illustrates heat exchanger 224 of FIG. 2 in more detail.

FIG. 4 illustrates heat exchanger 224 of FIG. 2 in more detail. Included with heat exchanger 224 may be a heat exchanger core frame 402, a handle 404, and a plurality of panels 406 that may be included as part of heat exchanger core 220. Core frame 402 may fix panels 406 in position. For example, core frame 402 may be a ¼ inch to ⅛ inch rubber/neoprene angle gasket applied to complete a seal around panels 406 and hold panels 406 in place as heat exchanger 224.

Handle 404 may aid in removing heat exchanger 224 from housing 150. For example, handle 404 may be attached to a core exterior 408 and lay flat in a non-utilize position and extend outward in a utilize position. Handle 404 may include plastic, metal, or other material.

Figure 5:
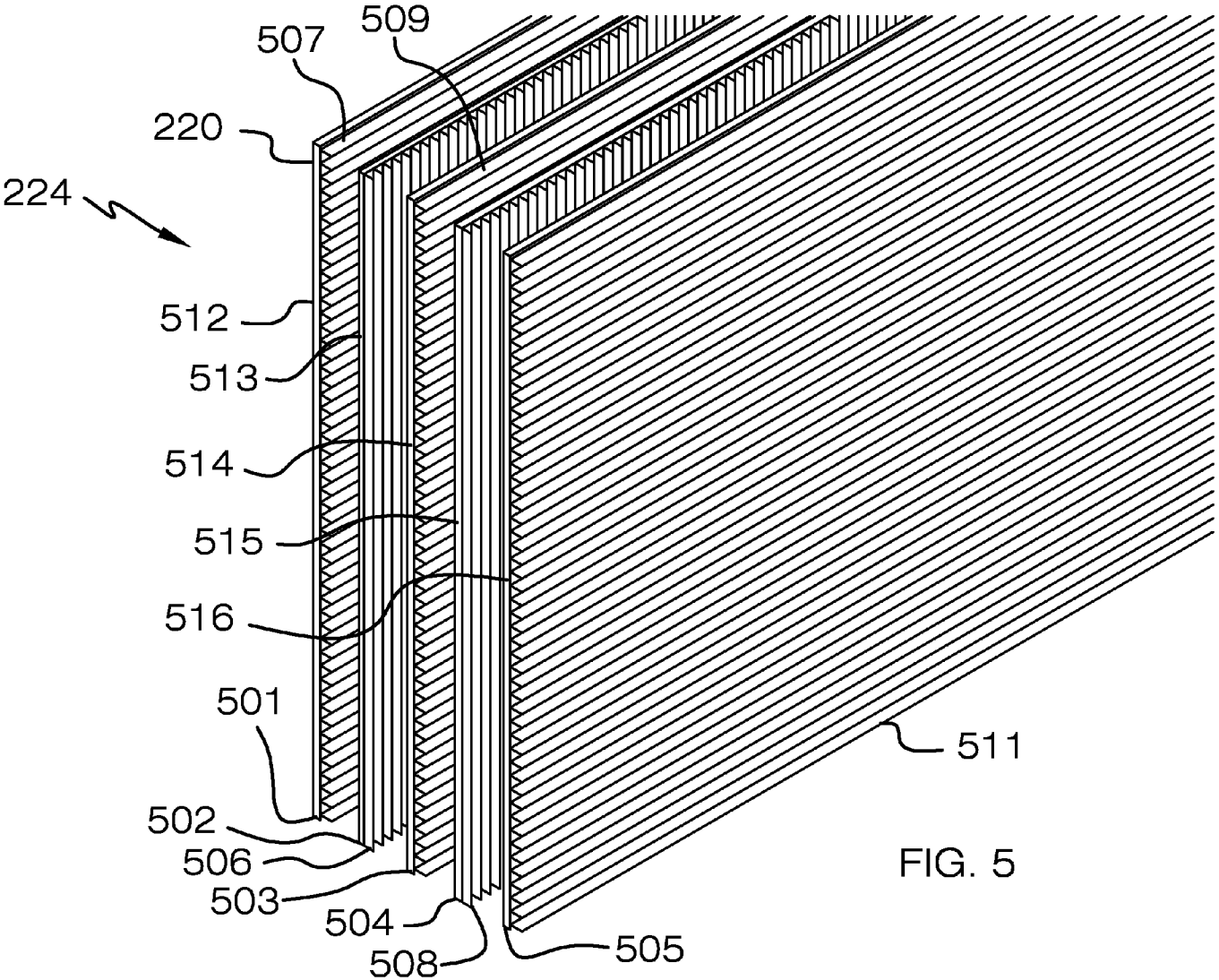
FIG. 5 is an isometric, exploded, partial view of heat exchanger 224 illustrating heat exchanger core 220.

FIG. 5 is an isometric, exploded, partial view of heat exchanger 224 illustrating heat exchanger core 220. Heat exchanger 224 may be thought of as a recuperative cross-flow heat exchange. In a recuperative heat exchange, fluids may exchange heat on either side of a dividing wall. In a cross-flow heat exchanger, the direction of the fluids may travel perpendicular to each other.

As noted above, heat exchanger core 220 may include a plurality of panels 406, such as a panel 501, a panel 502, a panel 503, a panel 504, and a panel 505. A cross sectional area of heat exchanger core 220 (or dryer air inlet compartment 225 (FIG. 2)) may be twice a cross sectional area of the dryer vent hose 118 (FIG. 2). This increase in area may slow down the hot dryer air 306 (FIG. 4) to permit better a heat exchange. Experiments have illustrated that a heat exchanger core 220 including forty-eight plates, each having a width of approximately one quarter inch, may present twice the cross sectional area of a four inch diameter dryer vent hose 118.

Each of the panels 406 may include fins secured to a plate. The fins may be straight, corrugated, or a combination thereof to increase surface area, channel fluid flow, and/or induce turbulence. For example panel 501, panel 503, and panel 505 each may have horizontally arranged fins 507, fins 509, and fins 511 respectively. Panel 502 and panel 504 each may have vertically arranged fins 506 and fins 508, respectively. Panels 501, 502, 503, 504, and 505 may have plates 512, 513, 514, 515, and 516.

By placing a free end of the fins of a particular panel 406 against an adjacent plate and interleaving those panels 406 having horizontal arranged fins with those panels 406 having vertically arranged fins such as illustrated in FIG. 5, the arrangement may form a recuperative cross-flow heat exchanger core 220 where hot dryer air 306 may flow horizontally and room temperature air 124 may flow vertically. Joints of heat exchanger core 220 may be sealed to prevent leaks from one flow channel to another. Heat exchanger core 220 may be manufactured from metal alloy extrusion.

For efficiency, heat exchanger 224 may be designed to maximize the surface area of the plates between the two fluids, while minimizing resistance to fluid flow through heat exchanger 224. Also, those panels 406 having horizontal arranged fins (such as panels 512, 514, and 516) may have their fins arranged to tilt slightly downward towards catch pan 222 (FIG. 2) to aid in removal of condensation.

Recovery unit 104 may be a rectangular wall-mounted cabinet that may measure approximately 30 inches long by 20 inches high by 12 inches deep. Most of the upper interior of recovery unit 104 may be dominated by a multi-plate heat exchanger. The heat exchanger may consist of a series of vertically oriented sheets, the one side of each of which may feature a series of closely spaced fins. The orientation of the fins may alternate 90 degrees for each successive sheet. A lower left-hand corner of recovery unit 104 may feature an attachment fitting for a standard dryer vent line. Internally, this may lead to a horizontal flow path through every other plate. Air may flow upwards through the other gaps by means of a 125-volt AC, elongated, centrifugal blower mounted in the lower center of the housing. The underside of the housing may contain the unit's room air intake, while the exhaust may be mounted on the upper end of the unit. The former may be equipped with a lint filter that could be accessed for cleaning via a hinged panel.

The heat exchanger may be mounted at a slight angle to facilitate the drainage of condensation from the dryer side of the heat exchanger into a bottom-mounted drip pan. The dryer side of the airflow path may terminate on the upper right-hand end of the unit. It could be linked to a standard vent line that could be directed out of the structure. The condensation drip pan could be linked to a downward section of tubing. This could be linked at the bottom end of the cabinet to a flexible tubing run that could be diverted into a laundry basin or floor drain.

The inlet end of the dryer side of the system may be equipped with a damper that could be utilized to direct flow to a bottom-mounted bypass route during the summer. Operation of the unit may be regulated by an inductive coil type sensor that may detect when the dryer was turned on. The unit could also feature an airflow sensor or related means that could be utilized to illuminate a "CLEAN FILTER" indicator light. A temperature sensor and high temperature warning light also may be included with the system.

Recovery unit 104 may include an in unit circuit breaker to prevent overheating. Since power for clothes dryer 102 may be first passed through controls box 210 of recovery unit 104, a shutdown function may kill power to both clothes dryer 102 and recovery unit 104 to minimize dryer fire. Recovery unit 104 may include a temperature range setting sensor to automatically activate gate flap 302.

Recovery unit 104 works towards fulfilling a market need to recover heat from a clothes dryer. The appealing features of Recovery unit 104 may include its ease of installation, convenience, efficiency, simplicity, and reliability. Recovery unit 104 may be installed in a relatively short period of time using common hand and power tools and may be adapted for utilize in conjunction with both gas and electric dryers. In operation, recovery unit 104 may provide an effective means of recovering most of the heat normally vented outside by a clothes dryer. The intake filter and condensate recovery system of recovery unit 104 may endow recovery unit 104 with a good level of reliability and safety, while its inductive control may make recovery unit 104 automatic in operation.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A heat recovery unit for a clothes dryer, the heat recovery unit comprising:

a housing having a support box and a cover attached to the support box by a hinge, where the cover includes an exhaust register and an indicator light cover through which a 'clean filter now' light, a 'low flow' light, and a 'high temperature warning' light are configured to be seen when lit;

a controls box positioned in the support box, where the controls box maintains electronic intelligence of the recovery unit, including the 'clean filter now' light, the 'low flow' light, and the 'high temperature warning' light;

a heat exchanger removably secure in the support box, where the heat exchanger is a recuperative cross-flow heat exchange;

a recovery unit fan positioned in the support box to blow room temperature air up through the heat exchanger;

a bypass channel configured to channel clothes dryer air around and outside of the heat exchanger;

a filter removably secure in the support box on an inlet side of the heat exchanger configured to filter out lint and dust;

a drip pan located in the support box on an exhaust side of the heat exchanger configured to catch condensate; and a catch pan located in the support box and configured to catch condensate from the drip pan.

2. The heat recovery unit of claim 1, where the support box includes a first shelf and a second shelf, where the first shelf supports a first male joint, the controls box, the recovery unit fan, the drip pan, and the bypass channel and where the second shelf supports the filter, a heat exchanger core, and the catch pan.

3. The heat recovery unit of claim 2, where the first male joint is configured to be utilized to port dirty hot air into the recovery unit, the heat recovery unit further comprising: a recovery vent hose configured to port dirty air out of a home and a power cord configured to provide power to recovery unit.

4. The heat recovery unit of claim 2, where the heat exchanger core is part of the heat exchanger, where the heat exchanger core is positioned in the housing to form a dryer air outlet compartment as an exit staging location for cool dryer air.

5. The heat recovery unit of claim 4, where a drain tube is connected between the drip pan and configured to be connected to a drain portion of the clothes washer.

6. The heat recovery unit of claim 1, where the controls box includes a power outlet configured to receive a clothes dryer power cord and to exercise power control over the clothes dryer.

7. The heat recovery unit of claim 6, where the controls box contains electronic connections.

8. The heat recovery unit of claim 1, where the heat exchanger further includes a core frame, a handle, and a plurality of panels.

9. The heat recovery unit of claim 8, where the core frame includes a ¼ inch to ⅛ inch rubber/neoprene angle gasket that is applied to complete a seal around the plurality of panels and hold panels in place.

10. The heat recovery unit of claim 9, where the handle is configured to aid in removing the heat exchanger from the housing, where the handle is attached to a core exterior and configured to lay flat in a non-utilize position and to extend outward in a utilize position, and where the handle includes one of plastic and metal.

11. The heat recovery unit of claim 8, where the heat exchanger is a recuperative cross-flow heat exchange.

12. The heat recovery unit of claim 11, where a cross sectional area of the heat exchanger core is twice a cross sectional area of a dryer vent hose included with the clothes dryer.

13. The heat recovery unit of claim 12, where the heat exchanger core includes forty-eight plates, each having a width of approximately one quarter inch.

14. The heat recovery unit of claim 13, where each of the plurality of panels includes fins secured to a plate, where the fins include horizontally arranged fins interleaved between vertically arranged fins, where the plurality of panels are arranged to cause hot dryer air to flow horizontally and room temperature air to flow vertically, where the horizontally arranged fins are arranged to tilt slightly downward to aid in removal of condensation.

15. A heat recovery unit for a clothes dryer, the heat recovery unit comprising:

a housing having a support box and a cover attached to the support box, where the cover includes an exhaust register and an indicator light cover;

a controls box positioned in the support box, where the controls box maintains electronic intelligence of the recovery unit;

a heat exchanger removably secure in the support box, where the heat exchanger is a recuperative cross-flow heat exchange;

a recovery unit fan positioned in the support box to blow room temperature air through the heat exchanger;

a bypass channel configured to channel clothes dryer air around and outside of the heat exchanger;

a filter removably secure in the support box on an inlet side of the heat exchanger configured to filter out lint and dust; and a drip pan located in the support box on an exhaust side of the heat exchanger configured to catch condensate.

16. The heat recovery unit of claim 15, where the indicator light cover is configured such that at least one of a 'clean filter now' light, a 'low flow' light, and a 'high temperature warning' light are configured to be seen when lit.

17. The heat recovery unit of claim 15, where the electronic intelligence of the recovery unit includes the 'clean filter now' light, the 'low flow' light, and the 'high temperature warning' light.

18. The heat recovery unit of claim 15, where the support box is attached to the cover by a hinge, where the recovery unit fan is positioned to blow room temperature air up through the heat exchanger after the heat recovery unit is installed, where the heat recovery unit further comprises: a catch pan located in the support box and configured to catch condensate from the drip pan.

* * * * *